US007408523B2

(12) United States Patent
Kong et al.

(10) Patent No.: US 7,408,523 B2
(45) Date of Patent: Aug. 5, 2008

(54) ANTENNA ASSEMBLY

(75) Inventors: Sung Ho Kong, Eujcongbu (KR); Gi Cho Kang, Seoul (KR)

(73) Assignee: Wireless Data Communication Co., Ltd., Seoul (KR)

( * ) Notice: Subject to any disclaimer, the term of this patent is extended or adjusted under 35 U.S.C. 154(b) by 83 days.

(21) Appl. No.: 11/344,055

(22) Filed: Jan. 31, 2006

(65) Prior Publication Data

US 2006/0192719 A1 Aug. 31, 2006

(30) Foreign Application Priority Data

Jan. 31, 2005 (KR) ..... 10-2005-0008635

(51) Int. Cl.
*H01Q 1/42* (2006.01)
*H01Q 1/38* (2006.01)

(52) U.S. Cl. ..... 343/789; 343/700 MS; 343/786

(58) Field of Classification Search ..... 343/700 MS, 343/786, 789, 797, 846, 702
See application file for complete search history.

(56) References Cited

U.S. PATENT DOCUMENTS

| | | | | |
|---|---|---|---|---|
| 4,031,538 | A * | 6/1977 | Lundgren, Jr. | 343/781 CA |
| 6,034,642 | A * | 3/2000 | Kojima et al. | 343/753 |
| 6,127,987 | A * | 10/2000 | Maruyama et al. | 343/835 |
| 7,187,328 | B2 * | 3/2007 | Tanaka et al. | 343/700 MS |
| 2004/0150575 | A1 * | 8/2004 | Lizalek et al. | 343/767 |
| 2006/0114168 | A1 * | 6/2006 | Gottl et al. | 343/797 |
| 2006/0192719 | A1 * | 8/2006 | Kong et al. | 343/789 |

* cited by examiner

*Primary Examiner*—Huedung Mancuso
(74) *Attorney, Agent, or Firm*—Workman Nydegger

(57) ABSTRACT

An antenna assembly is disclosed which can minimize interference of antennas for communication services. The antenna assembly is suitable to minimize side-lobes and back-lobes interfering with each other in antennas used in a repeater for communication services. The antenna assembly includes a reflector having a structure capable of minimizing radiation patterns having front-to-back ratio (FTBR) characteristics, namely, back-lobes.

35 Claims, 5 Drawing Sheets

ANTENNA ASSEMBLY

This application claims the benefit of Korean Patent Application No. P 2005-008635, filed on Jan. 31, 2005, which is hereby incorporated by reference as if fully set forth herein.

BACKGROUND OF THE INVENTION

1. Field of the Invention

The present invention relates to an antenna assembly, and more particularly, to an antenna assembly capable of minimizing interference of antennas for communication services.

2. Discussion of the Related Art

Generally, a repeater for mobile communication services includes a receiver antenna (donor antenna) and a transmitter antenna (coverage antenna).

Such an antenna includes a radiator and a reflector.

The radiator radiates or absorbs radio waves to/from subscriber's terminals in a communication service area.

The reflector is attached to a rear side of the radiator, to reflect the radio waves radiated from the radiator to the subscriber's terminals, or to reflect the radio waves absorbed by the subscriber's terminals.

Each antenna of a conventional repeater for mobile communication services which has the above-mentioned configuration, exhibits radiation patterns having front-to-back ratio (FTBR) characteristics and front-to-side ratio (FTSR) characteristics as shown in FIG. 1, due to scattering waves occurring at the edge of the reflector of the antenna. The radiation patterns having FTBR characteristics are back-lobes, whereas the radiation patterns having FTSR characteristics are side-lobes.

For this reason, the receiver antenna and transmitter antenna of the conventional repeater radiate a large amount of waves in lateral directions and in a back direction. As a result, signal interference occurs between the receiver antenna and the transmitter antenna.

In order to suppress such signal interference occurring between the receiver antenna and the transmitter antenna, a sufficient isolability must be secured between the two antennas. In order to secure a sufficient isolability, the receiver antenna and transmitter antenna in the above-mentioned conventional repeater for mobile communication services are arranged such that they are directed in opposite directions (180°-spaced directions). Also, a certain obstacle is placed between the receiver antenna and the transmitter antenna. Alternatively, the receiver antenna and transmitter antenna are spaced apart from each other by a sufficient distance. That is, the conventional repeater must be designed, taking into consideration the signal interference occurring between the receiver antenna and the transmitter antenna. For this reason, there is a difficulty in installing the antennas.

SUMMARY OF THE INVENTION

Accordingly, the present invention is directed to an antenna assembly that substantially obviates one or more problems due to limitations and disadvantages of the related art.

An object of the present invention is to provide an antenna assembly which can minimize side-lobes and back-lobes interfering with each other in antennas used in a repeater for communication services.

Another object of the present invention is to provide an antenna assembly which includes a reflector having a structure capable of minimizing radiation patterns having FTBR characteristics, namely, back-lobes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an antenna assembly comprises: a radiator which radiates or absorbs waves; and a reflector which includes at least one reflecting plate having a bottom wall and side walls being inclinedly extended from edges of the bottom wall in a wave radiation direction of the radiator, wherein the bottom wall is attached one wall of a housing arranged at a rear side in the wave radiation direction.

The housing may be electrically grounded.

The reflector may be provided with a hole centrally formed through the bottom wall of the reflector. The radiator may be formed in a central portion of the hole while being radially spaced apart from a peripheral edge of the hole by a predetermined distance.

The reflector may include two laminated reflecting plates. The bottom wall of a first one of the reflecting plates and the bottom wall of a second one of the reflecting plates may be attached to each other. The bottom wall of a lower one of the reflecting plates may be attached to the wall of the housing. The side wall of the first reflecting plate and the side wall of the second reflecting plate may be spaced apart from each other by a predetermined distance. The spacing between the side walls of the first and second reflecting plates may be shorter than a side wall length of the reflector in a direction in which the side walls extend from the bottom walls of the first and second reflecting plates, respectively. The spacing between the side walls of the first and second reflecting plates may be shorter than $\lambda/4$. The bottom wall of the lower reflecting plate may further extend beyond the edges of the bottom wall of the upper reflecting plate by a distance corresponding to the spacing between the side walls of the first and second reflecting plates.

The side walls of the first and second reflecting plates may extend from the bottom walls of the first and second reflecting plates, respectively, by a length longer than the spacing between the side walls of the first and second reflecting plates. The side walls of the first and second reflecting plates may extend from the bottom walls of the first and second reflecting plates, respectively, by a length corresponding to $\lambda/4$. The side walls of the first and second reflecting plates may extend from the bottom walls of the first and second reflecting plates, respectively, by a length corresponding to "$\lambda/4\pm\lambda/8$".

The side wall of the reflecting plate may extend inclinedly in a radial direction.

The side wall of the reflecting plate may extend inclinedly at an acute angle with respect to the bottom wall of the reflecting plate. The acute angle may be 45°.

The reflector may include at least three laminated reflecting plates. The bottom wall may be polygonal. For example, the bottom wall may be rectangular. The side wall may include first side wall portions extending inclinedly from respective edges of the bottom wall such that the first side wall portions have the same length, and second side wall portions each connecting adjacent ones of the first side wall portions. The bottom wall may be circular. The side wall may have a constant length over the entire portion of the side wall.

The reflector may be made of a conductive material.

In accordance with another aspect of the present invention, an antenna assembly comprises: a radiator which radiates or absorbs waves; and a reflector which includes a bottom wall attached to one wall of a housing arranged at a rear side in a wave radiation direction of the radiator, a first side wall extending inclinedly from edges of the bottom wall in the wave radiation direction of the radiator, and a second side wall extending inclinedly from the bottom wall while being parallel to the first side wall.

In accordance with another aspect of the present invention, an antenna assembly comprises: a radiator which radiates or absorbs waves; and a reflector which has a recessed structure, and includes a bottom wall attached to one wall of an electrically-grounded housing arranged at a rear side in a wave radiation direction of the radiator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The present invention provides an antenna assembly which can minimize side-lobes and back-lobes interfering with each other in antennas used in a repeater for communication services, and which can minimize radiation patterns having FTBR characteristics, namely, back-lobes.

In accordance with the present invention, in order to minimize lobes, in particular, back-lobes, a reflector is used which has a structure as shown in FIGS. 2 to 5. The reflector according to the present invention has the following features:

1. The reflector has a bottom wall attached to one side of a grounded housing over the entire lower surface of the bottom wall, a side wall having side wall portions extending inclinedly in a wave radiation direction from respective edges of the bottom wall, and connecting wall portions each connecting the adjacent side wall portions. For example, the housing is an outer box enclosing a body of a mobile communication repeater, and is arranged at the rear side in the wave radiation direction.

2. The bottom wall is attached to one side of the housing over the entire lower surface of the bottom wall.

3. The spacing between the side walls of first and second reflecting plates, which are included in a reflector when the reflector is configured as shown in FIG. 3B, or the spacing G between side walls of a reflector when the reflector is configured as shown in FIG. 3C, is shorter than the side wall length L of the reflector in a direction in which the side walls extend from the bottom wall. For example, the spacing G between the side walls is shorter than $\lambda/4$.

4. The side walls have the same length L in a direction in which the side walls extend from the bottom wall. The length L is longer than the spacing G between the side walls. For example, the side wall length L corresponds to $\lambda/4$. In another example, the side wall length L corresponds to "$\lambda/4\pm\lambda/8$".

Hereinafter, the antenna assembly according to the present invention will be described in more detail.

Figure 1:
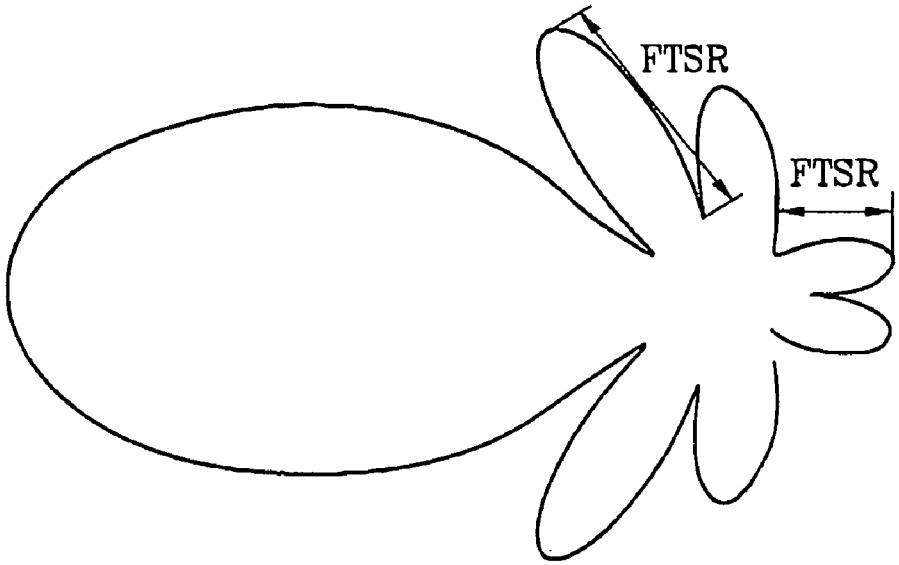
FIG. 1 is a schematic view illustrating radiation patterns caused by scattering waves occurring in antennas.
Figure 2A:
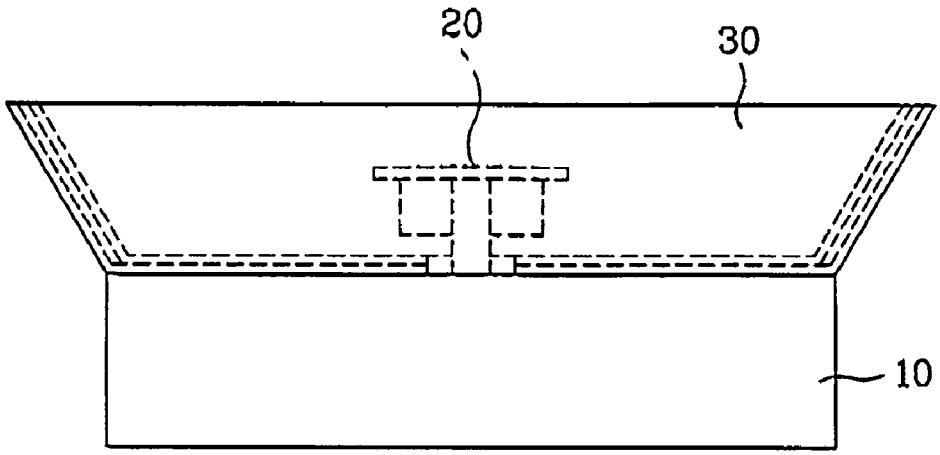
FIGS. 2A and 2B are side and perspective views illustrating a configuration of a repeater for communication services according to the present invention, respectively.
Figure 2B:
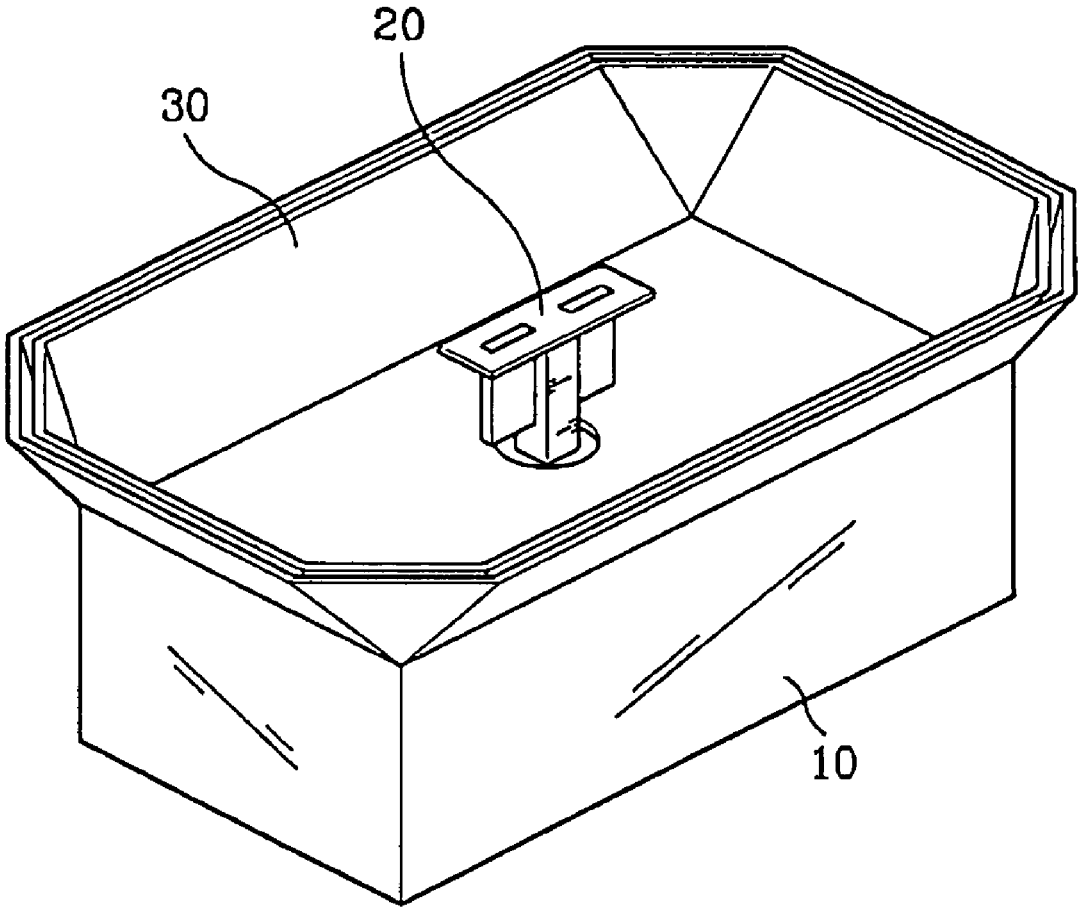

FIGS. 2A and 2B are side views illustrating a configuration of a repeater for communication services, to which the antenna assembly according to the present invention is applied.

In the case of FIGS. 2A and 2B, the antenna assembly includes an antenna circuit. Preferably, the antenna circuit is a body of the repeater which may be used for mobile communication services. The antenna circuit is protected by a grounded housing 10. Thus, the primary configuration of the antenna assembly according to the present invention includes the grounded housing 10, a radiator 20 which is electrically connected to the antenna circuit protected by the housing 10, and a reflector 30 which is attached to one side of the housing 10, and has a recessed structure.

The radiator 20 radiates or absorbs predetermined waves.

The housing 10 is arranged at the rear side in a wave radiation direction of the radiator 20. The reflector 30 is arranged at the rear side in the wave radiation direction, and is mounted between the housing 10 and the radiator 20.

The reflector 30, which is the heart of the antenna assembly according to the present invention, has a bottom wall or layer which is attached to one side of the housing 10 (the side to which the radiator 20 is mounted), and a side wall which extends inclinedly from the edges of the bottom wall. The side wall has one or more side wall portions each extending inclinedly from an associated one of the edges of the bottom wall to a predetermined length, and one or more side wall portions each connecting the adjacent side wall portions.

Meanwhile, the reflector included in the antenna assembly of the present invention has a multi-layer structure in which at least two reflecting plates each having a bottom wall and a side wall, identically to those of the above-described reflector structure, are laminated, as shown in FIGS. 2A to 3B. The multi-layer structure can provide a convenience in the manufacture of the reflector.

Of course, the reflector included in the antenna assembly of the present invention may have a structure having a bottom wall and at least one side wall, similarly to those of the above-described reflector configuration, as shown in FIG. 3C.

First, an embodiment of the present invention, in which the reflector has a multi-layer structure in which at least two reflecting plates each having a bottom wall and a side wall are laminated, will be described.

Figure 3A:
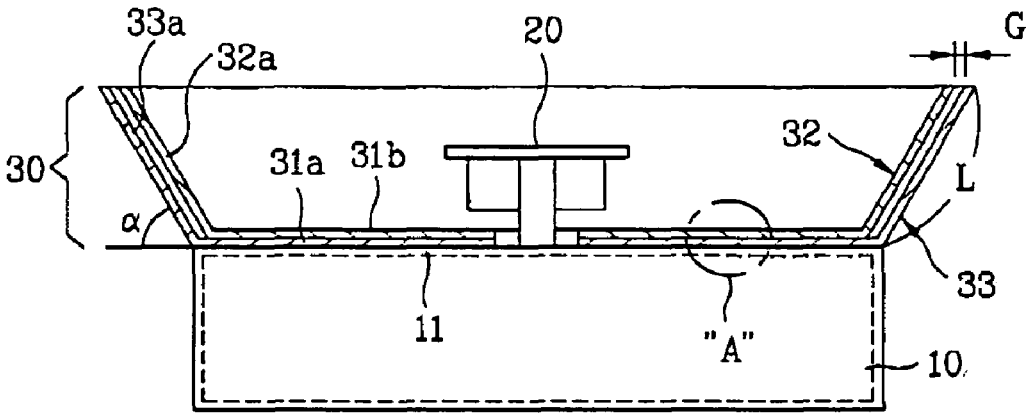
FIG. 3A is a longitudinal sectional view illustrating a repeater for communication services according to an exemplary embodiment of the present invention.
Figure 3B:
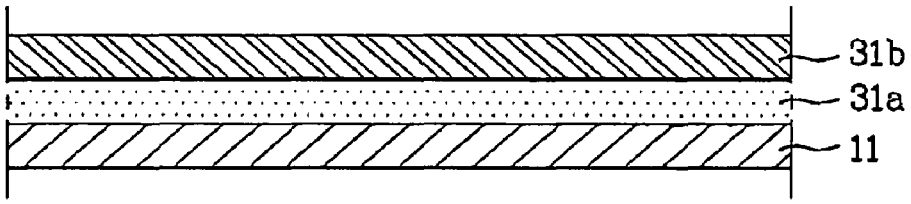
FIG. 3B is an enlarged view corresponding to a portion A of FIG. 3A.
Figure 3C:
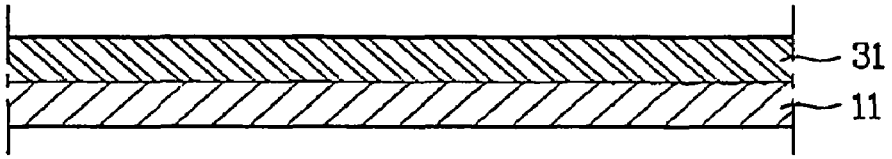
FIG. 3C is an enlarged view corresponding to a portion A of FIG. 3A, according to another exemplary embodiment of the present invention.

FIG. 3A is a longitudinal sectional view illustrating a repeater for communication services according to the present invention. FIG. 3B is an enlarged view corresponding to a portion A of FIG. 3A. The repeater shown in FIGS. 3A and 3B is illustrated as including a reflector having a multi-layer structure in which two reflecting plates are laminated. Of course, the present invention is not limited to the reflector structure in which two reflecting plates are laminated.

Referring to FIG. 3A, the housing 10 is electrically grounded. A lower one of the two reflecting plates 32 and 33, namely, the second reflecting plate 33, is attached to the housing 10 over the entire portion of a bottom wall 31*a* of the second reflecting plate 33. That is, the bottom wall 31*a* of the lower reflecting plate 33 is attached to one wall 11 of the housing 10. In particular, the lower surface of the bottom wall 31*a* of the second reflecting plate 33 is attached to the upper surface of the wall 11 of the housing 10 (namely, the wall to which a radiator is mounted).

The first reflecting plate 32 is arranged on the second reflecting plate 33 such that the first reflecting plate 32 is attached to the bottom wall 31*a* of the second reflecting plate 33 at a bottom wall 31*b* of the first reflecting plate 32. In detail, the lower surface of the bottom wall 31*b* of the first reflecting plate 32 is attached to the upper surface of the bottom wall 31*a* of the second reflecting plate 33.

A hole is centrally formed through the bottom walls 31*b* and 31*a* of the first and second reflecting plates 32 and 33. The radiator 20 is formed in a central portion of the hole, and is mounted to the wall 11 of the housing 10.

The radiator 20 is radially spaced apart from the peripheral edge of the hole by a predetermined distance.

The laminated first and second reflecting plates 32 and 33 have side walls 32*a* and 33*a*, which are spaced apart from each other by a predetermined distance, respectively. In detail, the spacing G between the side wall 32*a* of the first reflecting plate 32 and the side wall 33*a* of the second reflecting plate 33 is shorter than the length L of the side wall 32*a* or 33*a* of each reflecting plate 32 or 33 in a direction in which the side wall 32*a* or 33*a* extends from the bottom wall 31*b* or 31*a* of the reflecting plate 32 or 33.

Preferably, the spacing G between the side walls 32*a* and 33*a* of the first and second reflecting plates 32 and 33 is shorter than $\lambda/4$.

The bottom wall of the lower one of the first and second reflecting plates 32 and 33, namely, the bottom wall 31*a* of the second reflecting plate 33, further extends outwardly from the edges of the bottom wall 31*b* of the first reflecting plate 32 by a distance corresponding to the spacing G between the side walls 32*a* and 33*a*.

The length L of the side wall 32*a* or 33*a* of each reflecting plate 32 or 33 in a direction in which the side wall 32*a* or 33*a* extends from the bottom wall 31*b* or 31*a* of the reflecting plate 32 or 33 is longer than the spacing G between the side walls 32*a* and 33*a* of the first and second reflecting plates 32 and 33. In an exemplary embodiment of the present invention, it is preferred that the side wall length L of each reflecting plate 32 or 33 correspond to $\lambda/4$. In another exemplary embodiment of the present invention, the side wall length L of each reflecting plate 32 or 33 correspond to "$\lambda/4\pm\lambda/8$".

The side walls 32*a* and 33*a* of the reflecting plates 32 and 33 extend inclinedly in a radial direction from the bottom walls 31*b* and 31*a*, respectively. In particular, the side walls 32*a* and 33*a* of the reflecting plates 32 and 33 form an acute angle $\alpha$ with respect to the associated bottom walls 31*b* and 31*a*, respectively. Preferably, the acute angle $\alpha$ is 45°.

Figure 4:
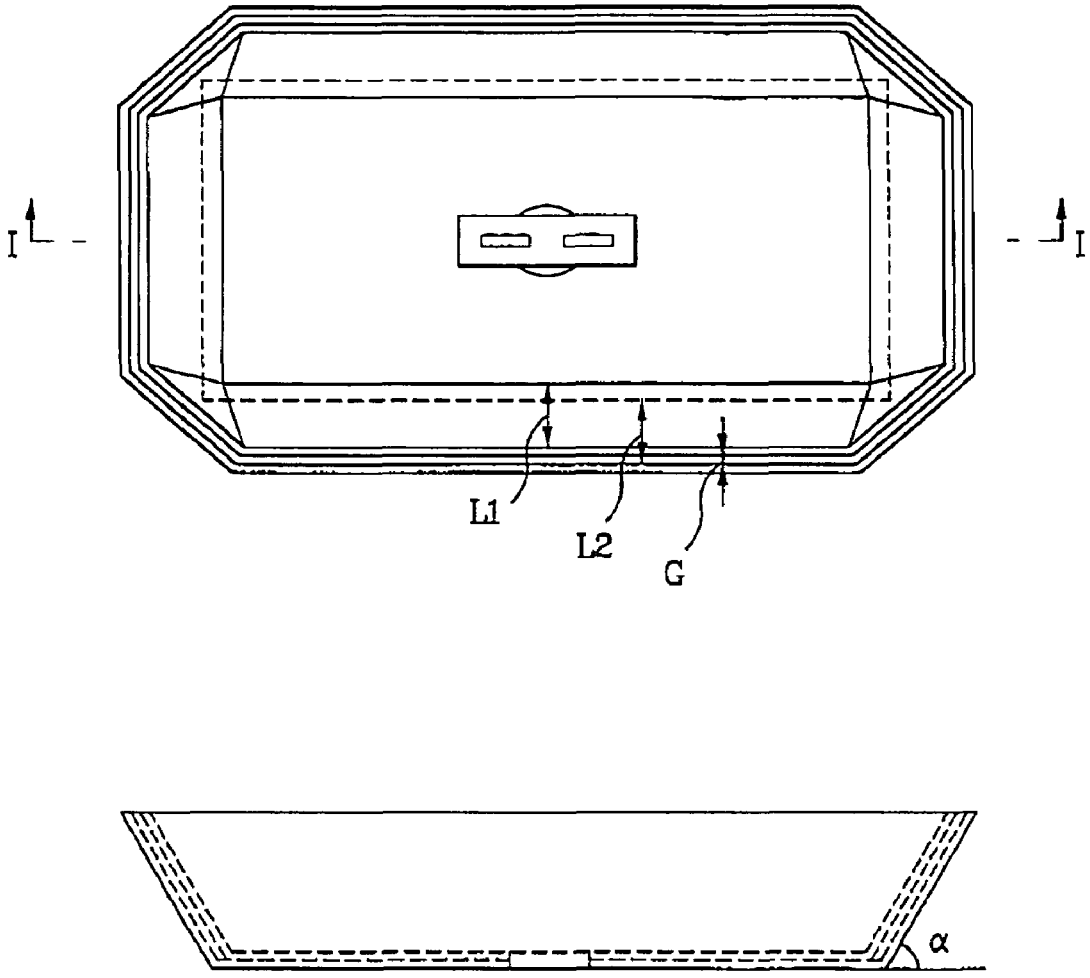
FIG. 4 illustrates a reflector included in the antenna assembly in accordance with a first embodiment of the present invention, through plan and side views.

Meanwhile, the bottom walls 31*b* and 31*a* of the reflecting plates 32 and 33 according to the present invention have a polygonal structure. Accordingly, the side wall 32*a* or 33*a* of each reflecting plate 32 or 33 extends inclinedly from the edges of the associated bottom wall 31*b* or 31*a* in the wave radiation direction of the radiator 20. The bottom walls 31*b* and 31*a* of the reflecting plates 32 and 33 according to the present invention may have a rectangular structure, as shown in FIG. 4. The bottom walls 31*b* and 31*a* of the reflecting plates 32 and 33 according to the present invention may also have a circular structure, as shown in FIG. 5.

This will be described in more detail only in conjunction with one of the reflecting plates 32 and 33, namely, the first reflecting plate 32. Where the bottom wall 31*b* of the first reflecting plate 32 has a rectangular structure, as shown in FIG. 4, the side wall 32*a* of the first reflecting plate 32 has side wall portions extending inclinedly from respective edges of the bottom wall 31*b* of the first reflecting plate 32 such that the side wall portions have the same length, and connecting wall portions each connecting the adjacent side wall portions.

Figure 5:
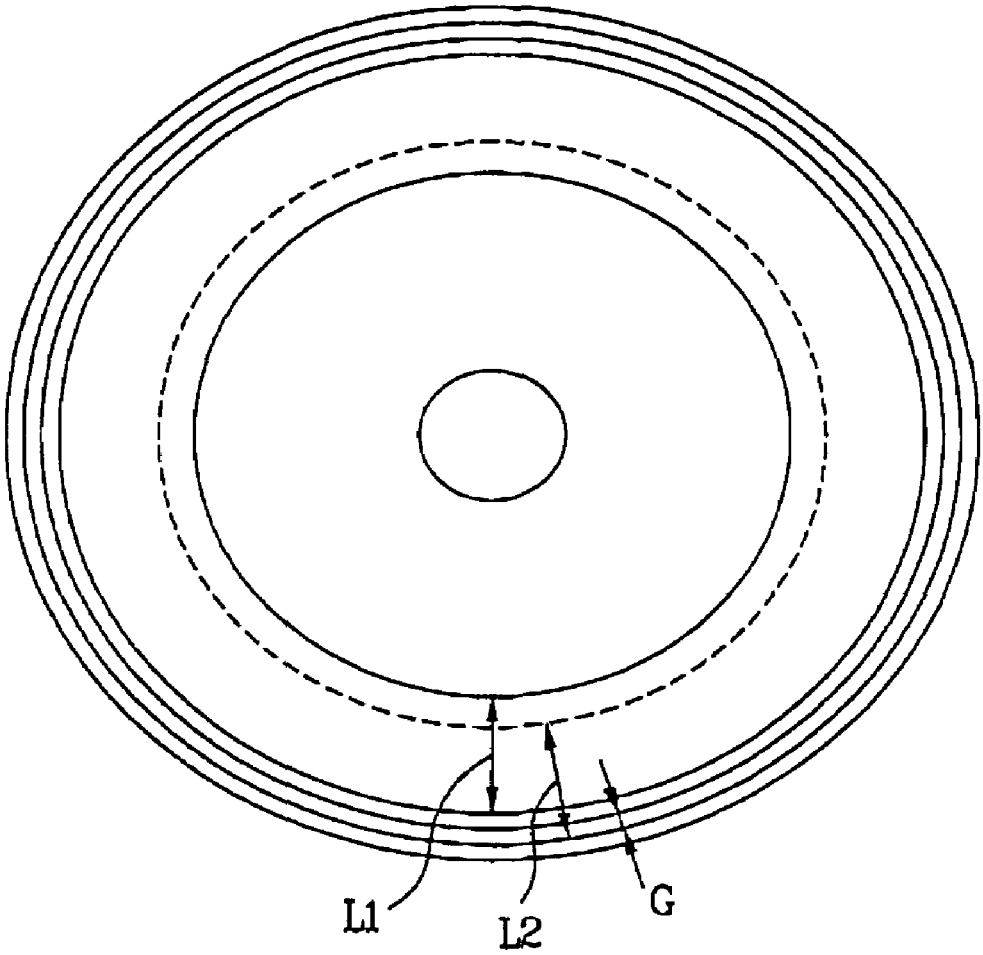
FIG. 5 illustrates a reflector included in the antenna assembly in accordance with a second embodiment of the present invention, through plan and side views.
Figure 5:
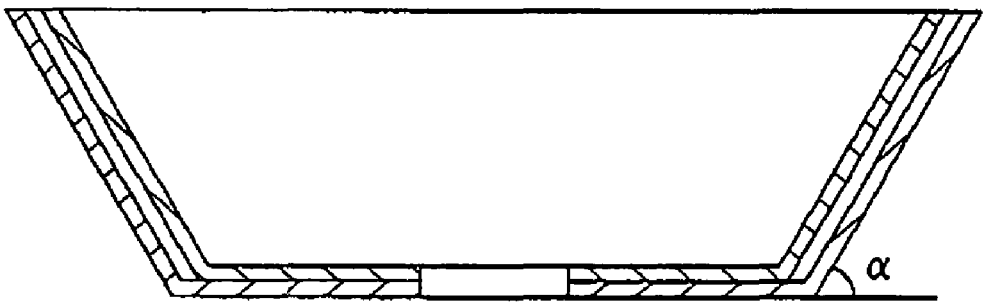

On the other hand, where the bottom wall 31*b* of the first reflecting plate 32 has a circular structure, as shown in FIG. 5, the first reflecting plate 32 has a single side wall extending inclinedly from the circumferential edge of the bottom wall 31*b* of the first reflecting plate 32.

Thus, the side walls 32*a* and 33*a* of the reflecting plates 32 and 33 extend inclinedly from the edges of the associated bottom walls 31*b* and 31*a* to a predetermined length such that each side wall 32*a* or 33*a* has a constant length over the entire portion thereof, irrespective of the shape of the bottom wall 31*b* or 31*a*. Accordingly, the side walls 32*a* and 33*a* of the first and second reflecting plates 32 and 33 have the same length.

The reflecting plates 32 and 33 are made of a conductive material.

FIG. 3C is an enlarged view corresponding to a portion A of FIG. 3A, illustrating a reflector which has a structure having a bottom wall and at least one side wall in accordance with another embodiment of the present invention. This reflector structure will be described in detail hereinafter.

In the case of FIG. 3C, the housing 10 is electrically grounded. The reflector 30 has a bottom wall 31 attached to one wall 11 of the housing 10. In particular, the lower surface of the bottom wall 31 of the reflector 30 is attached to the upper surface of the wall 11 of the housing 10 (namely, the wall to which a radiator is mounted). The reflector 30 also has side walls each extending inclinedly from the edges of the bottom wall 31 in a wave radiation direction of a radiator 20. In the illustrated case, the reflector 30 has two side walls, namely, a first side wall and a second side wall, which extend inclinedly from the edges of the bottom wall 31 and in parallel to each other.

A hole is centrally formed through the bottom wall 31 of the reflector 30. The radiator 20 is formed in a central portion of the hole, and is mounted to the wall 11 of the housing 10. The radiator 20 is radially spaced apart from the peripheral edge of the hole by a predetermined distance.

The first and second side walls of the reflector 30 are spaced apart from each other by a predetermined distance. In detail, the spacing G between the first and second side walls of the reflector 30 is shorter than the length L of each side wall of the reflector 30 in a direction in which the side wall extends from the bottom wall 31 of the reflector 30. Preferably, the spacing G between the side walls of the reflector 30 is shorter than $\lambda/4$.

The length L of each side wall of the reflector 30 in a direction in which the side wall extends from the bottom wall 31 of the reflector 30 is longer than the spacing G between the side walls of the reflector 30. In an exemplary embodiment of the present invention, it is preferred that the side wall length L of the reflector 30 correspond to λ/4. In another exemplary embodiment of the present invention, the side wall length L of the reflector 30 correspond to "λ/4±λ/8".

The side walls of the reflector 30 extend inclinedly in a radial direction from the bottom wall 31. In particular, the side walls of the reflector 30 form an acute angle a with respect to the bottom wall 31. Preferably, the acute angle α is 45°.

Meanwhile, the bottom wall 31 of the reflector 30 of FIG. 3C according to the present invention has a polygonal structure. Accordingly, the outer side wall of the reflector 30 extends inclinedly from the edges of the polygonal bottom wall 31 in the wave radiation direction of the radiator 20. Also, the inner side wall of the reflector 30 extends inclinedly from the polygonal bottom wall 31 in the wave radiation direction of the radiator 20 inside the outer side wall while being parallel to the outer side wall.

The bottom wall 31 of the reflector 30 according to the present invention may have a rectangular structure, as shown in FIG. 4. The bottom wall 31 of the reflector 30 according to the present invention may also have a circular structure, as shown in FIG. 5.

Where the bottom wall 31 of the reflector 30 has a rectangular structure, as shown in FIG. 4, each side wall of the reflector 30 has first side wall portions extending inclinedly from respective edges of the bottom wall 31 of the reflector 30 such that the first side wall portions have the same length, and second side wall portions each connecting the adjacent first side wall portions.

On the other hand, where the bottom wall 31 of the reflector 30 has a circular structure, as shown in FIG. 5, the reflector 30 has a single side wall extending inclinedly from the circumferential edge of the bottom wall 31.

Thus, the side walls of the reflector 30 extend inclinedly from the edges of the bottom wall 31 to a predetermined length such that each side wall has a constant length over the entire portion thereof, irrespective of the shape of the bottom wall 31. Accordingly, the side walls of the reflector 30 have the same length.

As apparent from the above description, when the antenna assembly having the above-described structure according to the present invention is used for a repeater for communication services, it is possible to minimize generation of radiation patterns having FTBR or FTSR characteristics caused by scattering waves occurring at the edge of the reflector of the antenna. Accordingly, a sufficient isolability can be secured between the receiver antenna and the transmitter antenna. As a result, the signal interference between the antennas is minimized.

Thus, when the antenna assembly of the present invention is used for mobile communications, installation of antennas, in particular, a repeater, can be easily achieved because the repeater can be free of signal interference.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An antenna assembly comprising:

a radiator which radiates or absorbs waves;

a housing which is arranged at a rear side in a wave radiation direction of the radiator;

a first reflector which includes a first bottom wall attached to one wall of the housing, and a first side wall extending inclinedly from edges of the first bottom wall in the wave radiation direction; and a second reflector which includes a second bottom wall attached to the first bottom wall, and a second side wall extending inclinedly from edges of the second bottom wall in the wave radiation direction and being spaced from the first side wall by a predetermined distance.

2. The antenna assembly according to claim 1, wherein the housing is electrically grounded.

3. The antenna assembly according to claim 1, wherein the first and second reflectors are provided with a hole centrally formed through the first and second bottom walls.

4. The antenna assembly according to claim 3, wherein the radiator is formed in a central portion of the hole while being radially spaced apart from a peripheral edge of the hole by a predetermined distance.

5. The antenna assembly according to claim 1, wherein the spacing between the first and second side walls is shorter than a side wall length of the first or second reflector in a direction in which the first and second side walls extend from the first and second bottom walls, respectively.

6. The antenna assembly according to claim 1, wherein the spacing between the first and second side walls is shorter than λ/4.

7. The antenna assembly according to claim 1, wherein the first bottom wall further extends beyond the edges of the second bottom wall by a distance corresponding to the spacing between the first and second side walls.

8. The antenna assembly according to claim 1, wherein the first and second side walls extend from the first and second bottom walls, respectively, by a length longer than the spacing between the first and second side walls.

9. The antenna assembly according to claim 1, wherein the first and second side walls extend from the first and second bottom walls, respectively, by a length corresponding to λ/4.

10. The antenna assembly according to claim 1, wherein the first and second side walls extend from the first and second bottom walls, respectively, by a length corresponding to "λ/4±λ/8".

11. The antenna assembly according to claim 1, wherein the first and second side walls extends extend inclinedly in a radial direction.

12. The antenna assembly according to claim 1, wherein the first and second side walls of the reflecting plate extend inclinedly at an acute angle with respect to the first and second bottom walls.

13. The antenna assembly according to claim 12, wherein the acute angle is 45°.

14. The antenna assembly according to claim 1, wherein the first and second bottom walls are polygonal.

15. The antenna assembly according to claim 14, wherein the first and second bottom walls are rectangular.

16. The antenna assembly according to claim 15, wherein the first side wall includes first side wall portions extending inclinedly from respective edges of the first bottom wall such that the first side wall portions have the same length, and second side wall portions each connecting adjacent ones of the first side wall portions, and the second side wall includes third side wall portions extending inclinedly from respective edges of the second bottom wall such that the third side wall portions have the same length, and fourth side wall portions each connecting adjacent ones of the third side wall portions.

17. The antenna assembly according to claim 1, wherein the first and second bottom walls are circular.

18. The antenna assembly according to claim 1, wherein the first side wall has a constant length over the entire portion of the first side wall, and the second side wall has a constant length over the entire portion of the second side wall.

19. The antenna assembly according to claim 1, wherein the first and second reflectors are made of a conductive material.

20. The antenna assembly according to claim 1, wherein the spacing between the first and second side walls is shorter than λ/4.

21. An antenna assembly comprising:

a radiator which radiates or absorbs waves;

a housing which is arranged at a rear side in a wave radiation direction of the radiator;

a reflector which includes a bottom wall attached to one wall of the housing, a first side wall extending inclinedly from edges of the bottom wall in the wave radiation direction of the radiator, and a second side wall extending inclinedly from the bottom wall while being parallel to the first side wall, wherein the first and second side walls being spaced apart from each other by a predetermined distance, wherein the spacing between the first and second side walls is shorter than a side wall length of the reflector in a direction in which the first and second side walls extend from the bottom wall.

22. The antenna assembly according to claim 21, wherein the reflector is provided with a hole centrally formed through the bottom wall of the reflector.

23. The antenna assembly according to claim 22, wherein the radiator is formed in a central portion of the hole while being radially spaced apart from a peripheral edge of the hole by a predetermined distance.

24. The antenna assembly according to claim 21, wherein the spacing between the first and second side walls is shorter than λ/4.

25. The antenna assembly according to claim 21, wherein the first side wall extends from the bottom wall by a length longer than the spacing between the first and second side walls.

26. The antenna assembly according to claim 25, wherein the length of the first side wall corresponds to λ/4.

27. The antenna assembly according to claim 25, wherein the length of the first side wall corresponds to "λ/4 λ/8".

28. The antenna assembly according to claim 21, wherein the second side wall extends from the bottom wall by a length longer than the spacing between the first and second side walls.

29. The antenna assembly according to claim 28, wherein the length of the second side wall corresponds to λ/4.

30. The antenna assembly according to claim 28, wherein the length of the second side wall corresponds to "λ/4±λ/8".

31. The antenna assembly according to claim 21, wherein the side walls of the reflector extends inclinedly in a radial direction.

32. The antenna assembly according to claim 21, wherein the side walls of the reflector extends inclinedly at an acute angle with respect to the bottom wall.

33. The antenna assembly according to claim 32, wherein the acute angle is 45°.

34. The antenna assembly according to claim 21, wherein the first or second side wall includes first side wall portions extending inclinedly from respective edges of the bottom wall such that the first side wall portions have the same length, and second side wall portions each connecting adjacent ones of the first side wall portions.

35. The antenna assembly according to claim 21, wherein the housing is electrically grounded.

* * * * *